United States Patent [19]

Rayl

[11] Patent Number: 4,789,418

[45] Date of Patent: Dec. 6, 1988

[54] TAPE MACHINE

[75] Inventor: Waldo G. Rayl, Ada, Ohio

[73] Assignee: Gasdorf Tool & Machine Co., Inc., Lima, Ohio

[21] Appl. No.: 122,793

[22] Filed: Nov. 19, 1987

[51] Int. Cl.[4] ..... B32B 31/00

[52] U.S. Cl. ..... 156/468; 53/137; 156/475; 156/486; 156/522; 226/162; 242/65

[58] Field of Search ..... 156/468, 475, 486–489, 156/492, 521, 522; 53/137; 242/65–66, 75, 75.45; 226/158

[56] References Cited

U.S. PATENT DOCUMENTS

| | | | |
|---|---|---|---|
| 2,652,166 | 9/1953 | Johnson | 156/552 X |
| 3,250,483 | 5/1966 | Printz et al. | 242/65 |
| 3,561,190 | 2/1971 | Derenthal | 53/137 |
| 4,045,273 | 8/1977 | Loveland et al. | 156/486 |
| 4,214,937 | 7/1980 | Geurtsen et al. | 226/158 X |
| 4,306,477 | 12/1981 | Travis | 226/162 X |

*Primary Examiner*—David Simmons

*Attorney, Agent, or Firm*—Emch, Schaffer, Schaub & Porcello Co.

[57] ABSTRACT

A high speed tape machine for applying tape to carton assemblies is disclosed. The tape machine includes spaced sidewalls and a tape assembly for supporting a roll of tape depending from the sidewalls. A stripper cylinder having a reciprocating stripper roller pulls tape from the roll. A tape head is pivoted to the sidewalls and directs tape from the roll to a carton assembly moving along a predetermined path. A trigger retards rotation of the tape head. A knife cuts the tape after the tape is applied to a carton. A wipe down assembly including pressing rollers engages the tape after its application to the carton assembly and presses the tape against the carton assembly.

16 Claims, 11 Drawing Sheets

TAPE MACHINE

BACKGROUND OF THE INVENTION

The present invention is a tape machine and more specifically a high speed tape machine which can be used to tape corrugated pasteboard cartons and carton assemblies on a production line basis. The tape machine has the capability of applying an L-clip tape at each end of a carton such that one piece of tape extends up the side, around the bottom corner and inwardly along a bottom of the carton assembly for a distance approximately the same as the distance that it extends upwardly on the end of the carton assembly. A similar L-clip is place at each end of the carton assembly.

In another embodiment, a C-clip is placed on the carton assembly. In this situation the tape extends up one end completely along the bottom of the carton assembly and up the other end of the carton assembly.

SUMMARY OF THE INVENTION

The present invention is directed to a high speed tape machine which includes at least one sidewall with a tape assembly depending from the sidewall. A stripper assembly is mounted adjacent the tape assembly and a tape head is pivotally mounted adjacent a predetermined path along which a carton assembly moves. A trigger assembly is operatively connected to the tape head. Knife means is provided for severing the tape after it is applied to the carton assembly. A wipe down assembly is mounted adjacent the predetermined path and presses the tape against the carton assembly after the tape has been applied.

DESCRIPTION OF THE PREFERRED EMBODIMENTS

Figure 11:
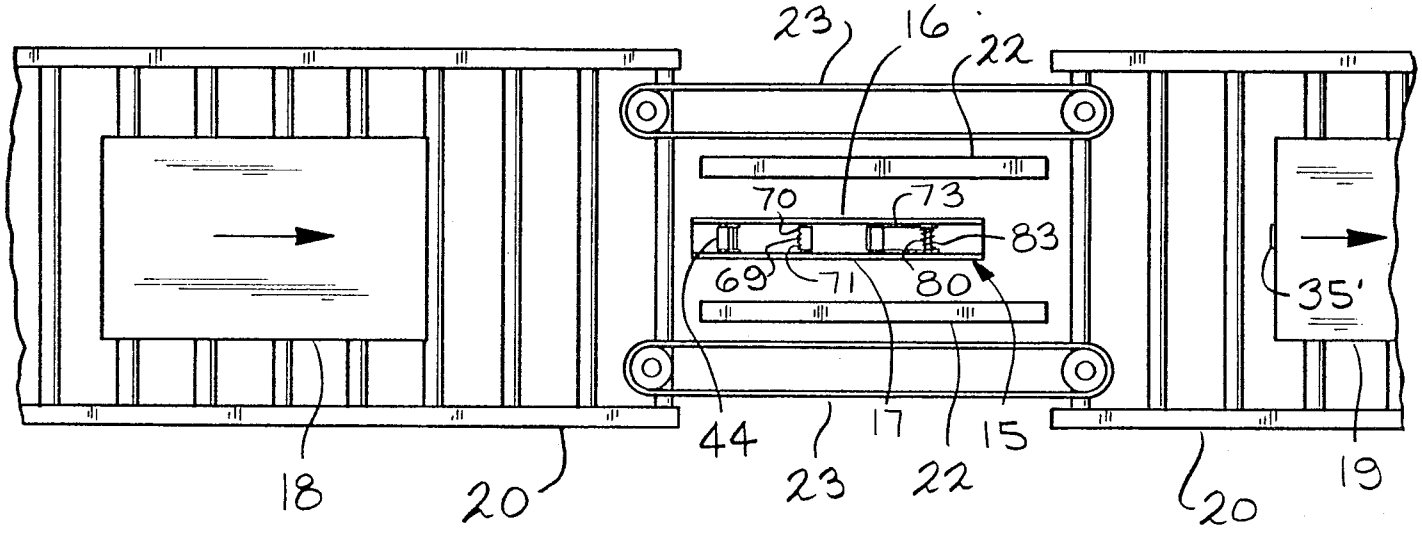
FIG. 11 is a top elevational view showing a tape machine, according to the present invention, and a conveyor system for moving carton assemblies over the tape machine to apply tape to the ends and bottom of the serially moved carton assemblies.

Referring to FIG. 11, a tape machine according to the present invention is generally indicated by the reference number 15. The tape machine 15 includes a pair of spaced apart sidewalls 16 and 17. Carton assemblies 18 and 19 are positioned on a conveyor 20 and are serially moved over the tape machine 15. The carton assembly 19 has already left the tape machine 15 and has had tape applied while the carton assembly 18 is approaching the tape machine 15. The tape machine 15 is a high speed tape machine which moves at a rate of approximately 15 inches per second. In the embodiment depicted, a carton assembly 18 or 19 has tape applied at each and every 2.7 seconds.

A pair of skids 22 are positioned adjacent to and parallel the tape machine 15 and a pair of drive belts 23 engage and drive the carton assemblies 18 and 19 along a predetermined path defined along the upper surface of the tape machine 15.

Figure 1:
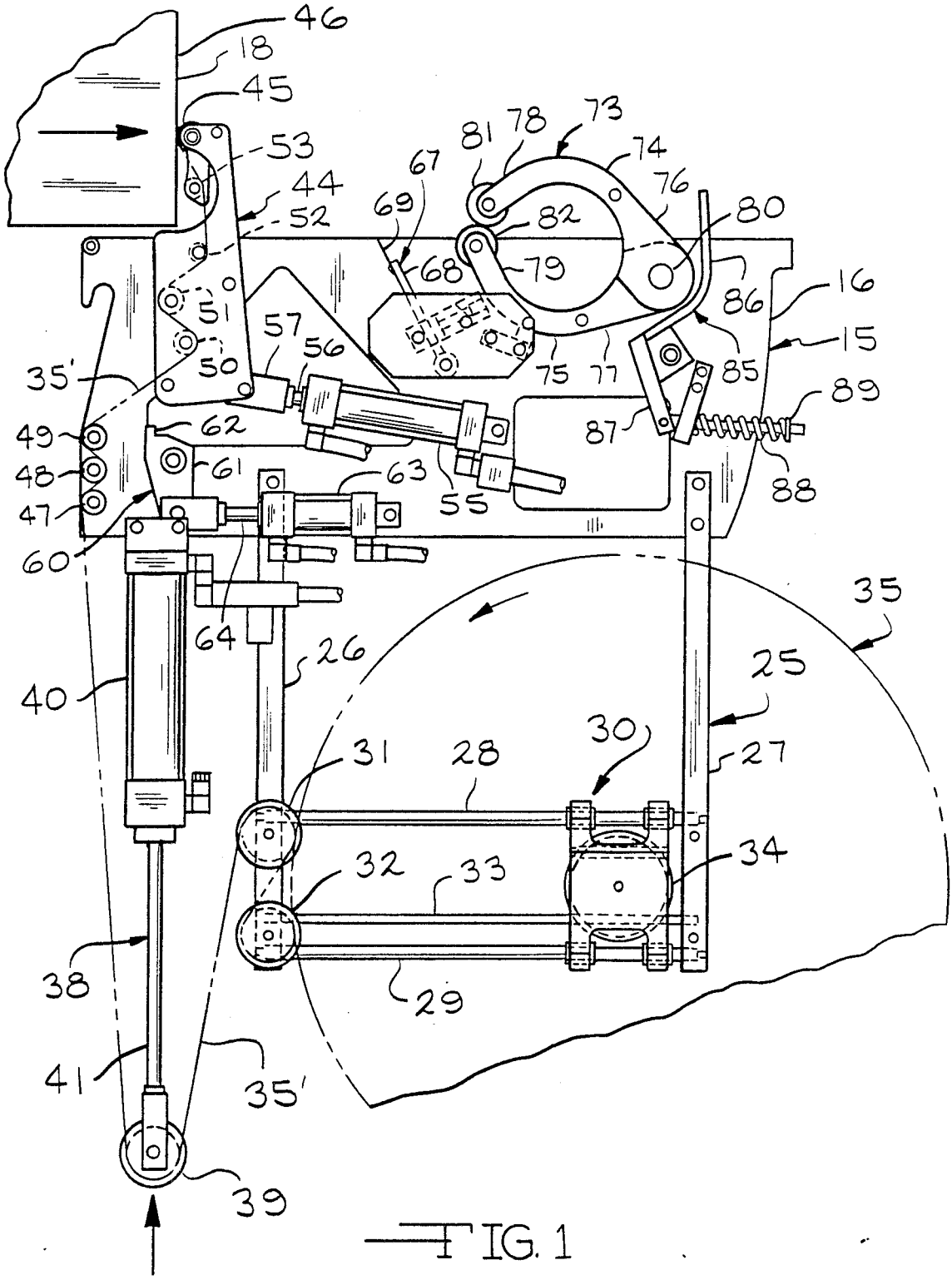
FIG. 1 is a side view of a tape machine, according to the present invention having one of the opposed sidewalls removed for clarity.

Referring to FIG. 1, the carton 18 is shown as it begins to move over the tape machine 15 along the predetermined path. The tape machine 15 includes a tape assembly 25 which depends from one or more of the sidewalls 16 and 17. In the present embodiment, the tape assembly 25 includes a pair of spaced depending arms 26 and 27 which are connected to the sidewalls 16 and 17. The arms 26 and 27 mount a pair of spaced cross arms 28 and 29 which in turn mount a slide assembly 30. A one way roller 31 is mounted on the depending arm 26 while a lower roller 32 is mounted on the depending arm 26 adjacent the cross arm 29. A spring shaft 33 extends between the depending arms 26 and 27 and is operatively connected to the slide assembly 30. The spring shaft 33 urges the slide assembly 30 toward the vertically positioned rollers 31 and 32.

A spool 34 is mounted on the slide assembly 30. The spool 34 in turn mounts a roll of tape generally indicated by the reference number 35. As the tape, indicated by the designation 35', is removed from the roll 35, the roll of tape 35 is urged by the spring shaft 33 to a position adjacent the vertically aligned rolls 31 and 32 as indicated in FIG. 1. As shown in FIG. 1, the tape roll 35 rotates in a counterclockwise direction and the tape 35' first passes around the lower roller 32 and then around the upper one way roller 31. The urging of the tape roll 35 to the position shown and the use of the one way roller 31 tends to prevent overrunning of the tape roll 35 due to its mass.

While different types of tape may be utilized with the tape machine 15, according to the present invention, it has been found that two types of tape manufactured by 3-M Corporation, which are identified as No. 898 Glass Fiber tape and No. YR 8809-R Polyester Reinforced tape, both provide the strength and other characteristics which are useful in the tape machine 15 of the present invention.

An important feature of the present invention is a stripper assembly, generally indicated by the reference number 38. The stripper assembly 38 is mounted adjacent the tape assembly 25 and includes a drive roller 39 which engages the tape 35' and strips the tape 35' from the roll 35. The stripper assembly 38 maintains the proper tension on the tape 35' at all times during the operation of the tape machine 15.

The stripper assembly 38 also includes a drive cylinder 40 which has its upper end mounted to the sidewalls 16 and 17. The cylinder 40 includes a drive rod 41 which mounts the drive roller 39 at it distal or lower end.

A tape head 44 is pivotally mounted above the stripper assembly 38 to the sidewall 16 and is also mounted adjacent the predetermined path along which the carton assembly 18 travels. Referring to FIG. 1, the tape head 44 includes an application roller 45 which engages and initially applies the tape 35' to an edge or end 46 of the carton assembly 18. As the tape 35' moves upwardly from the drive roller 39 it passes around three vertically aligned rollers 47, 48 and 49 mounted on the sidewall 16. Preferably, the roller 48 is a one way roller. The tape 35' then passes around rollers 50,51,52 and 53 mounted on the tape head 44 and then onto the application roller 45. Again, the roller 50 is preferably a one way roller. The one way rollers retard the tape 35' from moving in a reverse direction as the drive rod 41 of the stripper assembly 38 is extended to strip additional tape from the roll of tape 35.

Referring to FIG. 1, a head cylinder 55 having a rod 56 is mounted on the sidewall 16 adjacent the tape head 44. The extendable rod 56 mounts a block 57 which is in turn pivotally connected to the tape head 44. Extension or retraction of the head cylinder rod 56 pivots the application roller 45 of the tape head 44 toward or away from the predetermined path of the carton 18.

A trigger assembly 60 is operatively connected to the tape head 44. The trigger assembly 60 includes a trigger member 61 having a notch 62. The trigger member 61 is pivotally mounted to the sidewall 16 and is pivoted by a trigger cylinder 63 having a rod 64 operatively connected to the trigger member 61. When the trigger member 61 is in a first position, shown in FIG. 2, the block 57 of the tape head 44 is received by the notch 62 of the trigger member 61. Upon retraction of the trigger cylinder rod 64, as shown in FIG. 3, the trigger member 61 is pivoted out of engagement with the tape head block 57 and the tape head 44 is then released and may be pivoted by extension or retraction of the tape head cylinder rod 56.

As shown in FIG. 1, knife means 67 for severing the tape 35' is mounted on the sidewall 16 adjacent the tape head 44. The knife means 67 includes a blade holder 68 which mounts a blade 69. As shown in FIG. 11, the blade 69 preferably has a serrated upper end which extends across the centerline of the predetermined path of the carton assembly 18. In addition, one side 70 of the blade 69 is slightly higher than the other side 71 of the blade. It has been found that this slight difference in elevation results in a quick cut of one side of the tape which quickly progresses across the entire tape during the cutting operation. In addition, the blade holder 68 is pivotally mounted and is free to travel generally along the predetermined path thereby allowing the tape 35' to be cut on the fly. This provides a very quick and efficient means of cutting the tape 35'.

A wipe down assembly 73 is pivotally mounted on the sidewall 16 adjacent the predetermined path for pressing the tape 35' against the carton assembly 18 after the tape has been applied to such carton assembly 18. The wipe down assembly 73 includes a pair of curved arms 74 and 75. The curved arms 74 and 75 have first ends 76 and 77 and second ends 78 and 79. The first ends 76 and 77 are pinned together on a pivot shaft 80. The second ends 78 and 79 each mount wiping rollers 81 and 82. As shown in FIG. 11, a spring 83 is positioned on the pivot shaft 80 and urges the curved arms 74 and 75 towards the closed position shown in FIG. 1.

In addition, a return spring assembly 85 is pivotally mounted adjacent the wipe down assembly 73. The return spring assembly 85 includes a pressure bar 86 which is connected to an arm 87. A shaft 88 extends outwardly from the distal end of the arm 87 and mounts a compression spring 89. As the carton assembly 18 passes over the wiping rollers 81 and 82 (see FIG. 4) the curved arm 75 engages the pressure bar 86 and rotates it in a clockwise direction, as viewed from FIG. 4. This in turn pulls the shaft 88 to the left and compresses the spring 89. After the carton assembly 18 moves through the tape machine 15 and past the position shown in FIG. 10, the compression spring 89 expands and returns the wipe down assembly 73 to its FIG. 1 position.

Figure 2:
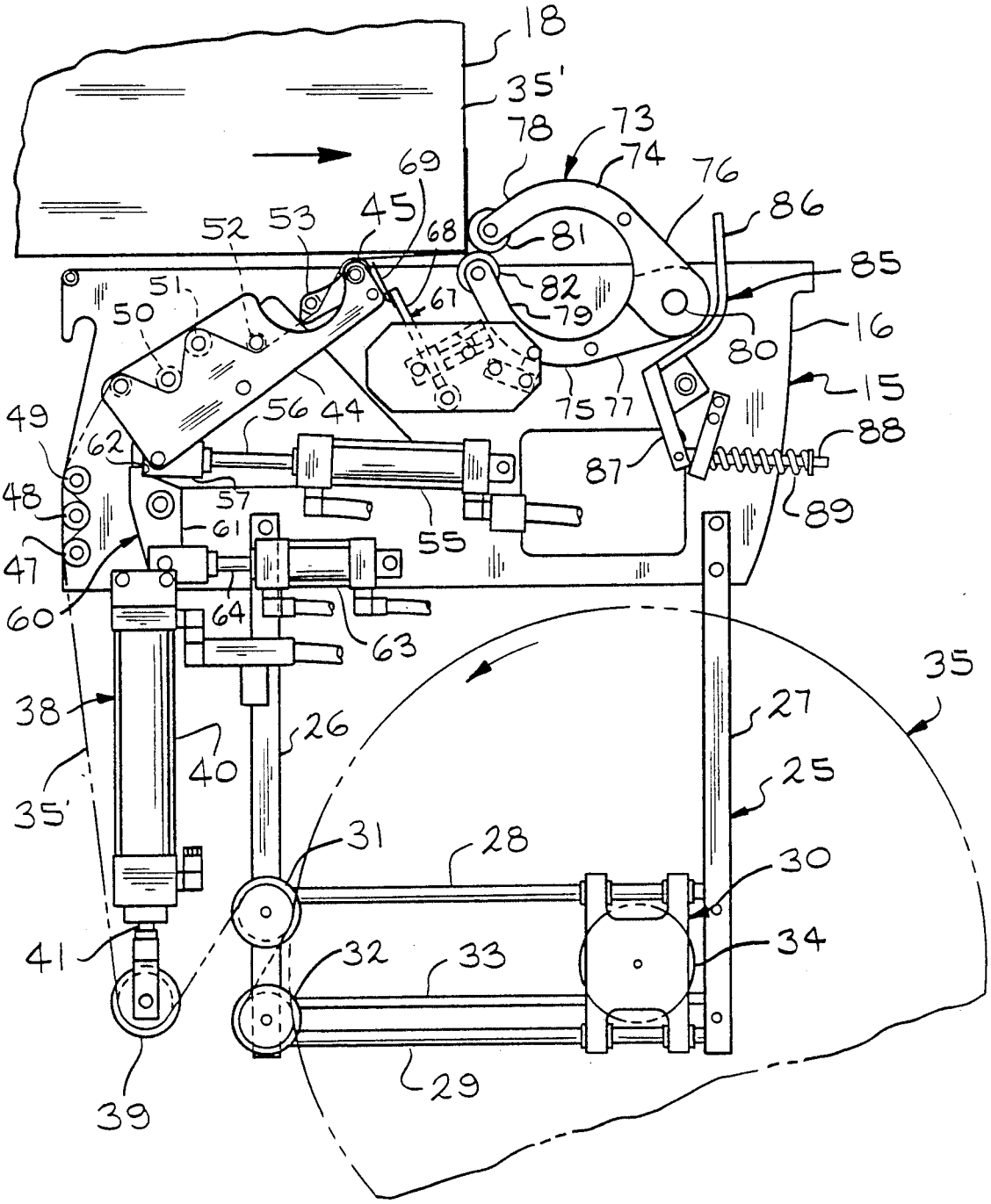
FIGS. 2–10 are side views similar to FIG. 1 showing a carton assembly as it progressively moves through the tape machine and showing the preferred position of the elements of the tape machine.
Figure 3:
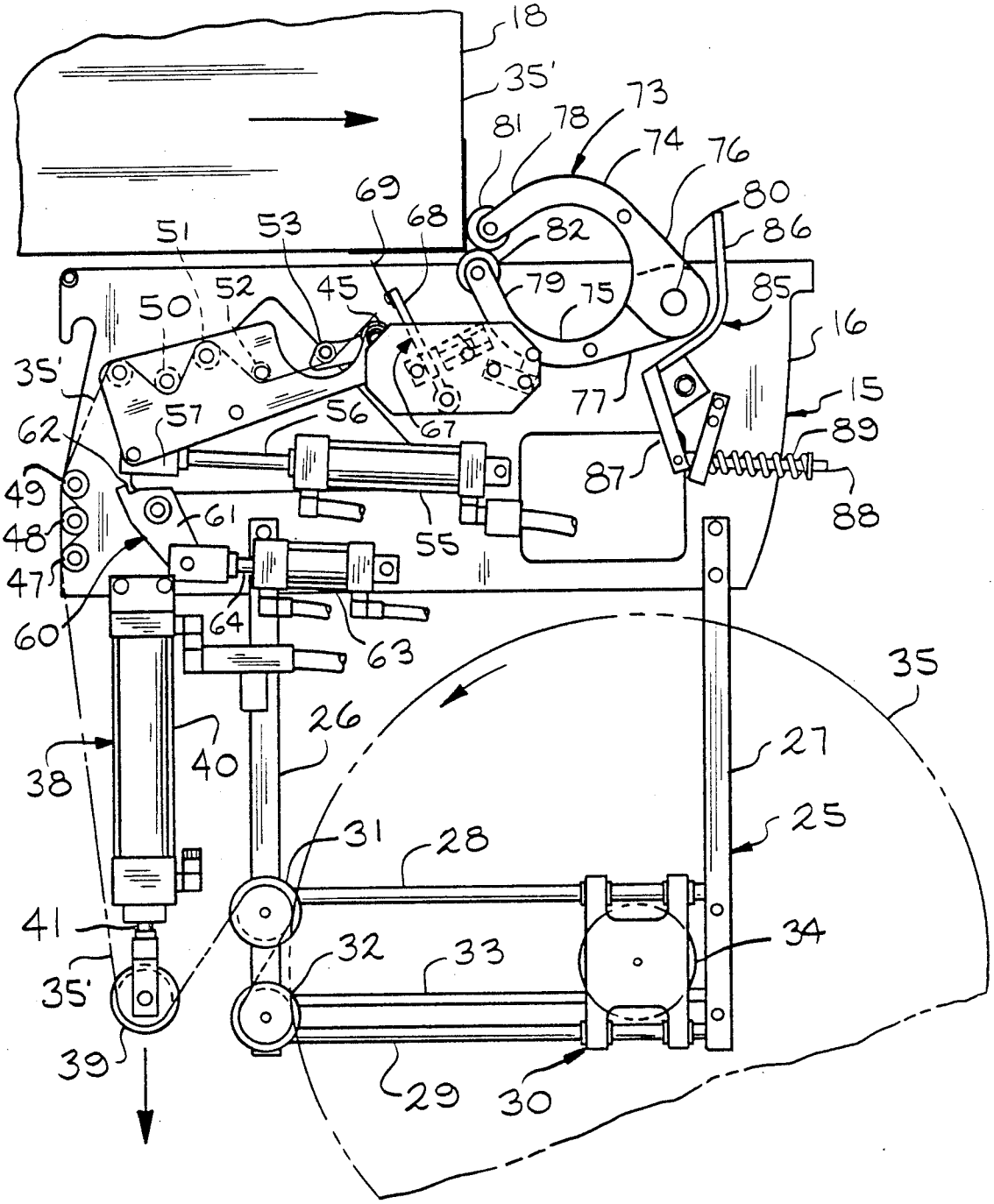

Referring now to FIGS. 1–10, a typical application of the tape machine 15 is shown in progressive steps. In this situation, L-clips of tape are applied at each end of the carton assembly 18. As shown in FIG. 1, the application roller 45 of the tape head 44 has engaged the end of the carton assembly 18 and has pressed the cut edge of the tape 35' against the side edge of the carton assembly 18. The drive rod 41 of the drive cylinder 40 has been extended to strip the required amount of tape 35' from the roll 35. Pressure in the drive cylinder 40 has been released to allow the drive rod 41 to retract so that the tape 35' may be fed upwardly and applied to the carton assembly 18. Referring to FIG. 2, the cylinder 55 is energized and the rod 56 extended to pivot the tape head 44 downwardly. The blade 69 engages the tape 35' to cut the other end of the L-clip. As previously noted, the blade holder 68 is free to move slightly to the right allowing the tape 35' to be cut on the fly. At the same time, still referring to FIG. 2, the cylinder 63 is pressurized placing the trigger member 61 into its triggering position wherein the block 57 is engaged in the notch 62 of the trigger member 61. Still referring to FIG. 2, the end of the carton assembly 18 is now engaging the wipe down assembly 73 and the wiping rollers 81 and 82 will begin their move along the legs of the L-clip to press the L-clip tightly against the carton assembly 18. When in the FIG. 2 position, the tape head cylinder 55 is energized but rotation is retarded by the trigger assembly 60.

Referring to FIG. 3, the rod 64 of the trigger cylinder 63 is retracted and the trigger assembly 60 released. The rod 56 of the tape head cylinder 55 is further extended to rotate the tape head 44 in a clockwise direction. As the application roller 45 is moved downwardly, the tape 35' is moved downwardly relative to the blade 69 of the knife means 67 and the cut completed. Also referring to FIG. 3, the drive cylinder 40 is again energized and the drive rod 41 of the stripper assembly 38 begins to extend. This in turn moves the drive roller 39 downwardly to strip additional tape from the tape roll 35.

Figure 4:
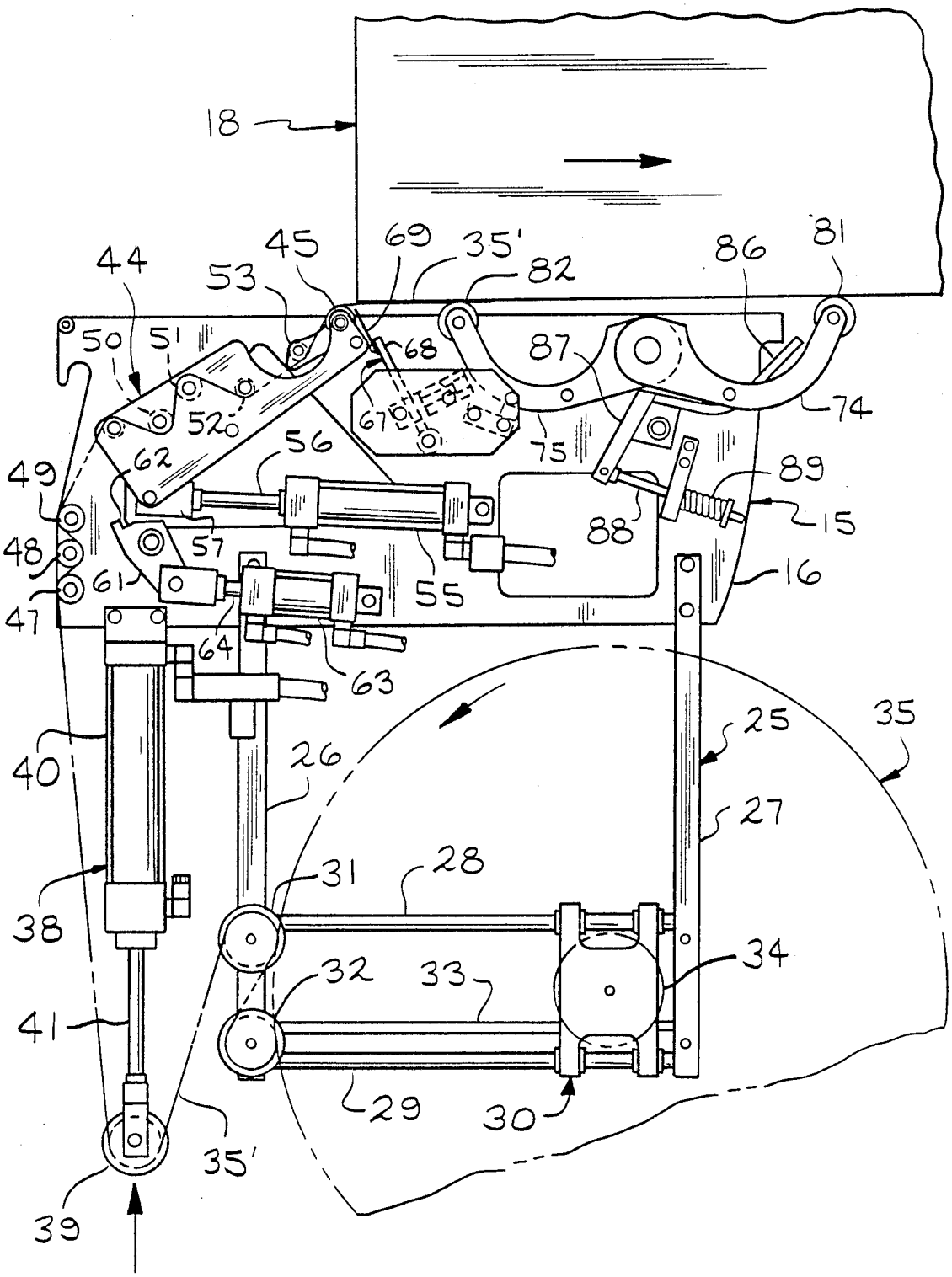

Referring to FIG. 4, the rod 56 of the tape head cylinder 55 has been retracted to pivot the application roller 45 of the tape head 44 upwardly and apply an L-clip to the other end of the carton assembly 18. The rod 64 of the trigger cylinder 63 is still retracted and the trigger assembly 60 is still in the relaxed position. The drive rod 41 is in the process of retraction allowing the tape 35' to be fed upwardly. Still referring to FIG. 4, as the carton assembly moves to the right, the curved arms 74 and 75 of the wipe down assembly 73 are completely open and the wiping rollers 81 and 82 are progressively pressing against the bottom legs of the L-clips.

In this position, the pressure bar 86 has been rotated downwardly and the spring 89 of the return spring assembly 85 compressed.

Figure 5:
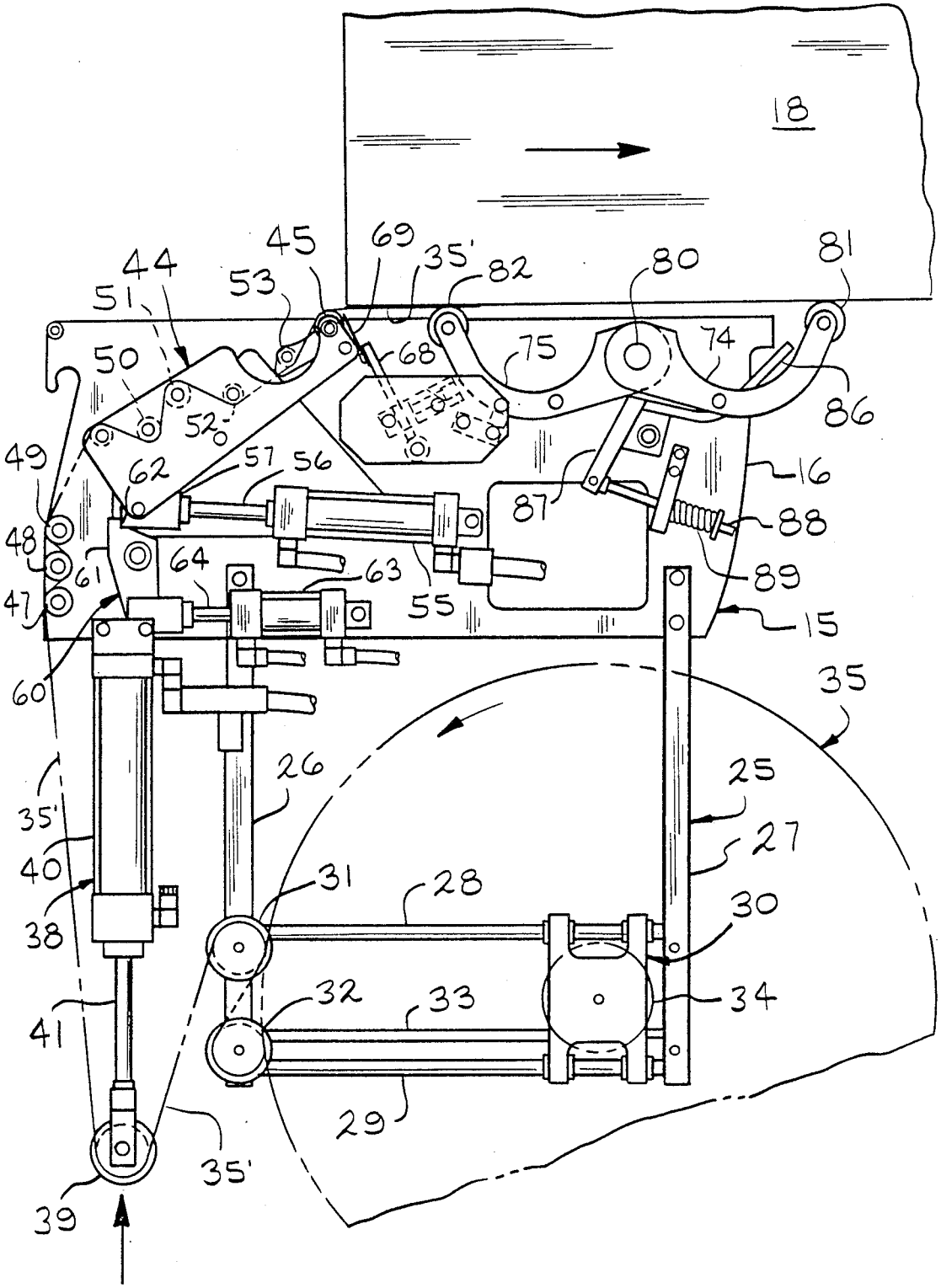

Referring to FIG. 5, the trigger cylinder rod 64 is extended to reset the trigger member 61. This holds the tape head 44 and its application roller 45 in position for the further application of the second L-clip.

Figure 6:
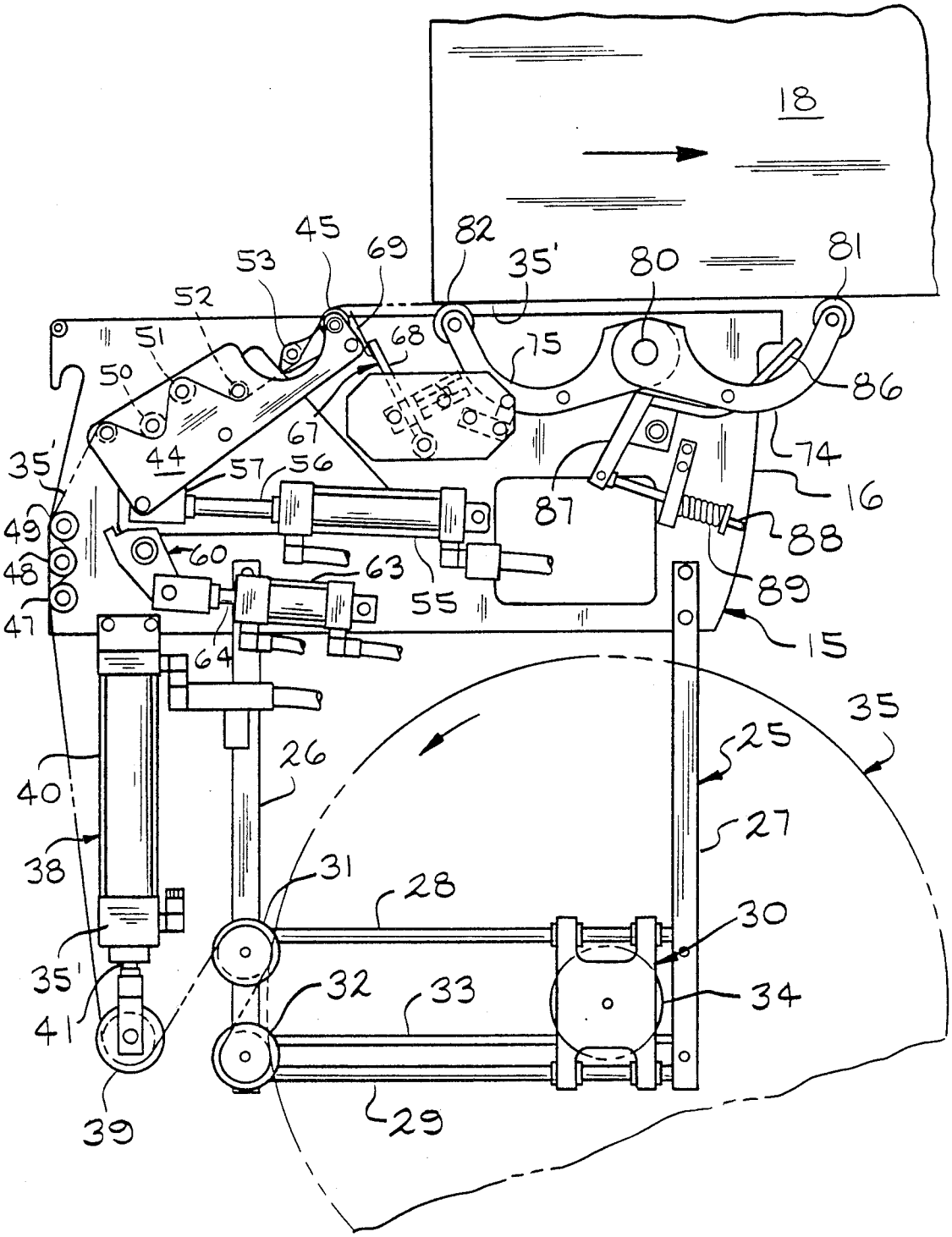

Referring to FIG. 6, the drive rod 41 of the drive cylinder 40 is completely retracted and the drive roller 39 moved to its up position thereby supplying sufficient tape 35' to complete the second L-clip. The rod 64 of the trigger cylinder 63 is retracted triggering the trigger member 61. The rod 56 of the tape head cylinder 55 begins to extend thereby beginning the downward movement of the application roller 45.

Figure 7:
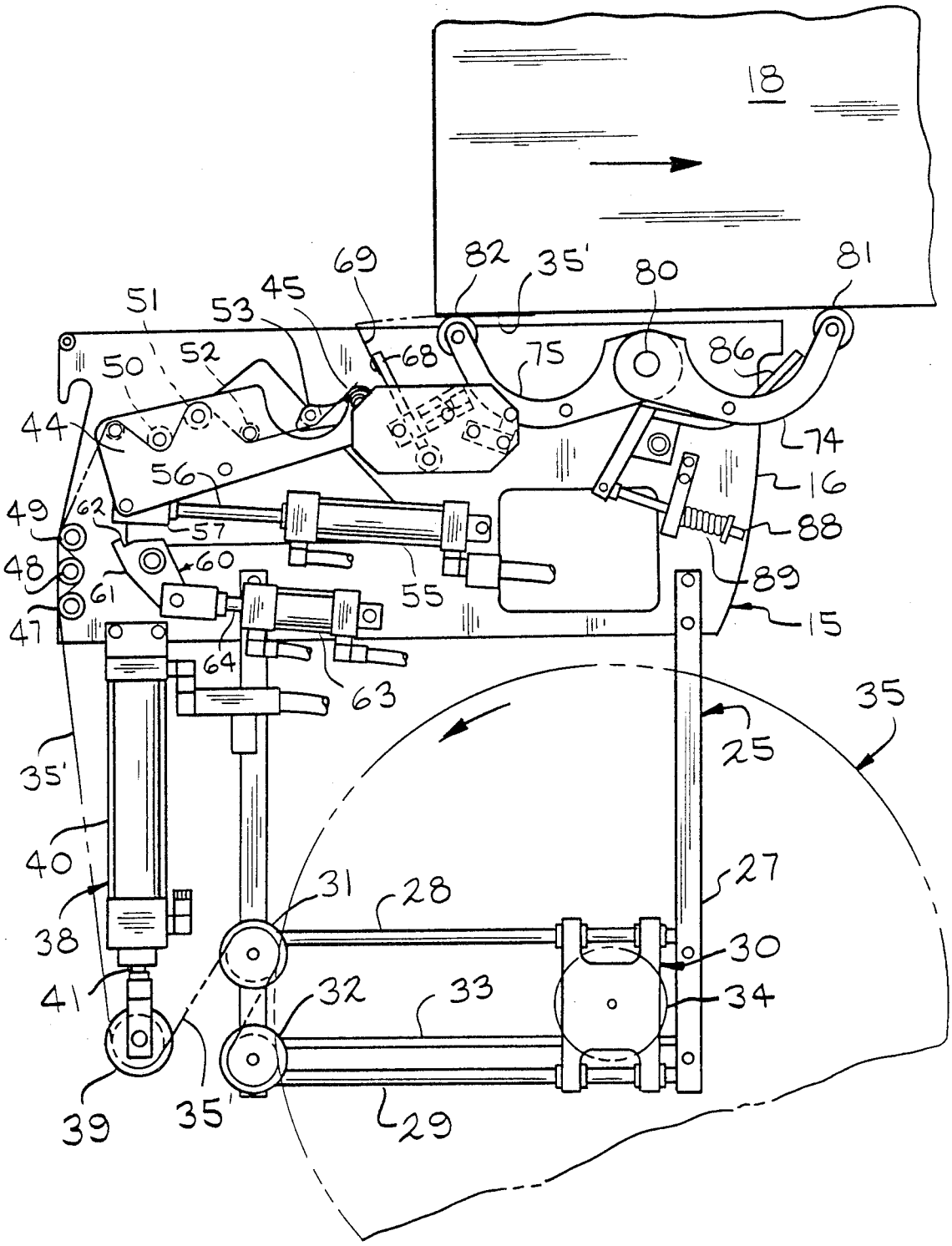

Referring to FIG. 7, the downward movement of the application roller 45 has continued and the other end of the L-clip has been cut by the blade 69. The trigger assembly 60 is still in the release position as the rod 56 of the tape head cylinder 55 continues to extend.

Figure 8:
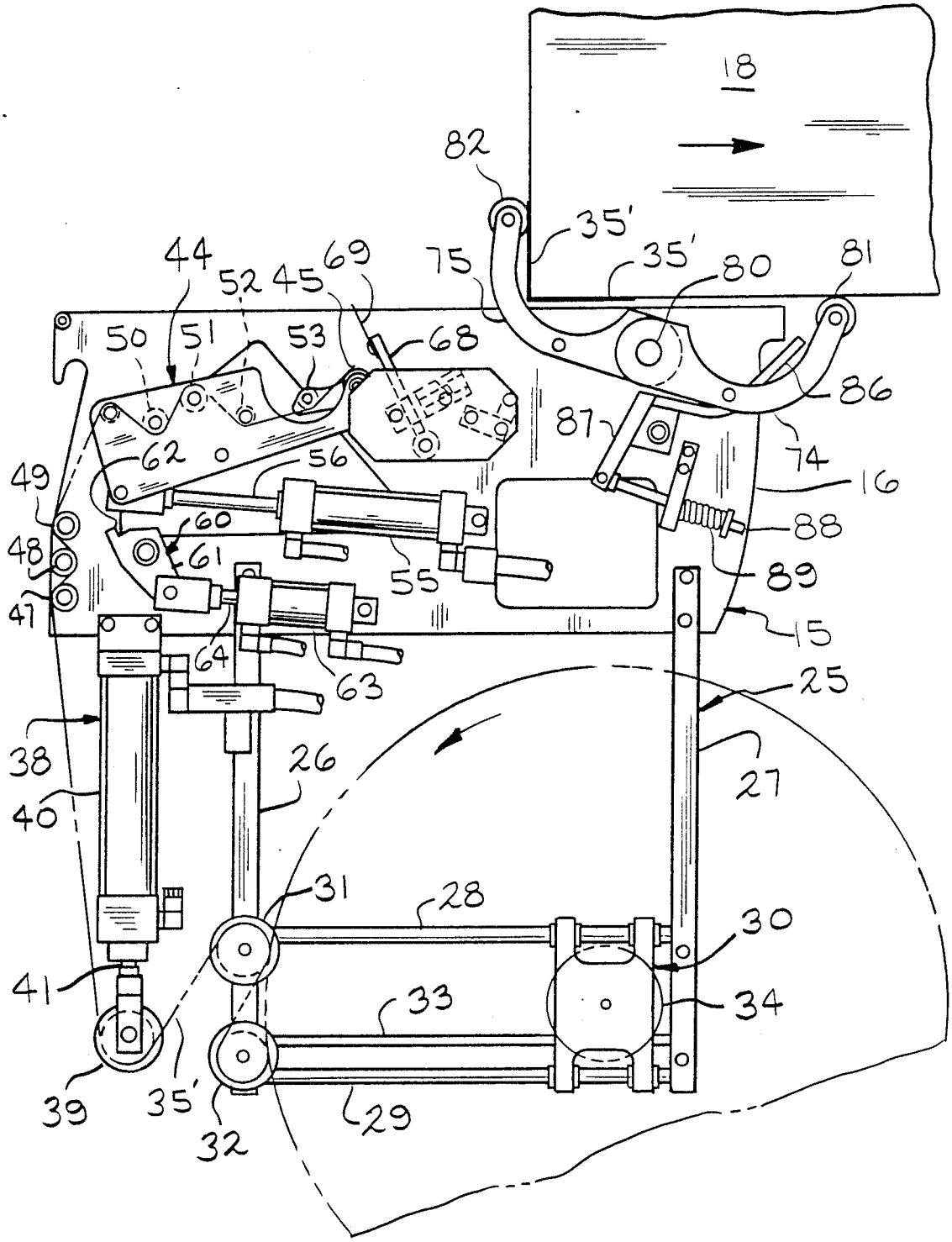

Referring to FIG. 8, the carton assembly 18 continues its movement along the tape machine 15 with the wiping roller 82 of the wipe down assembly 73 moving up the other end of the carton assembly 18 to complete the pressing of the L-clip.

Figure 9:
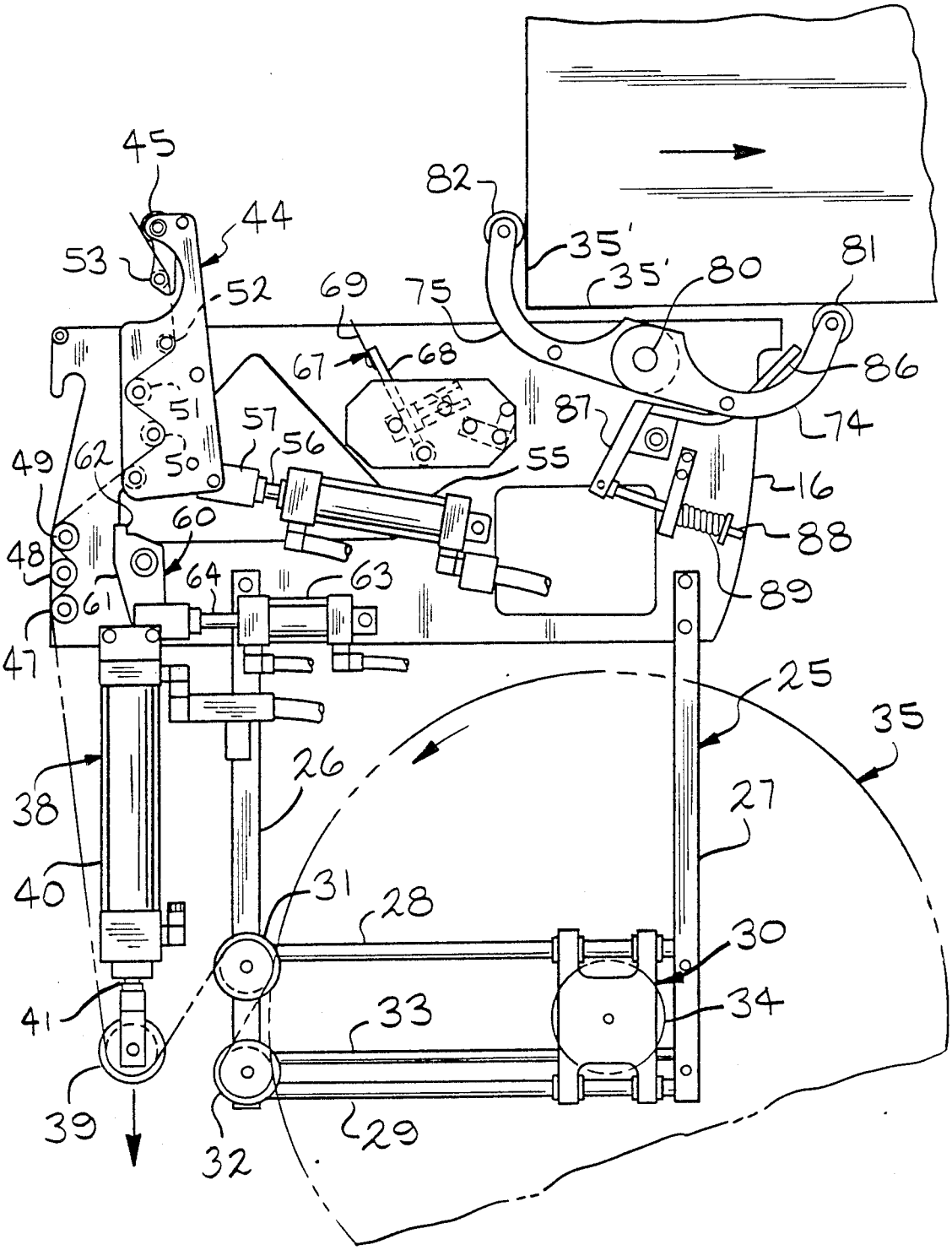

Referring to FIG. 9, the drive cylinder 40 is energized to move the drive roller 39 downwardly to strip tape from the tape roll 35 for another cycle of the tape machine 15. The drive rod 64 of the trigger cylinder 63 is extended to cock the trigger member 61. The rod 56 of the tape head cylinder 55 has been retracted to rotate the tape head 44 to its maximum counterclockwise position.

Figure 10:
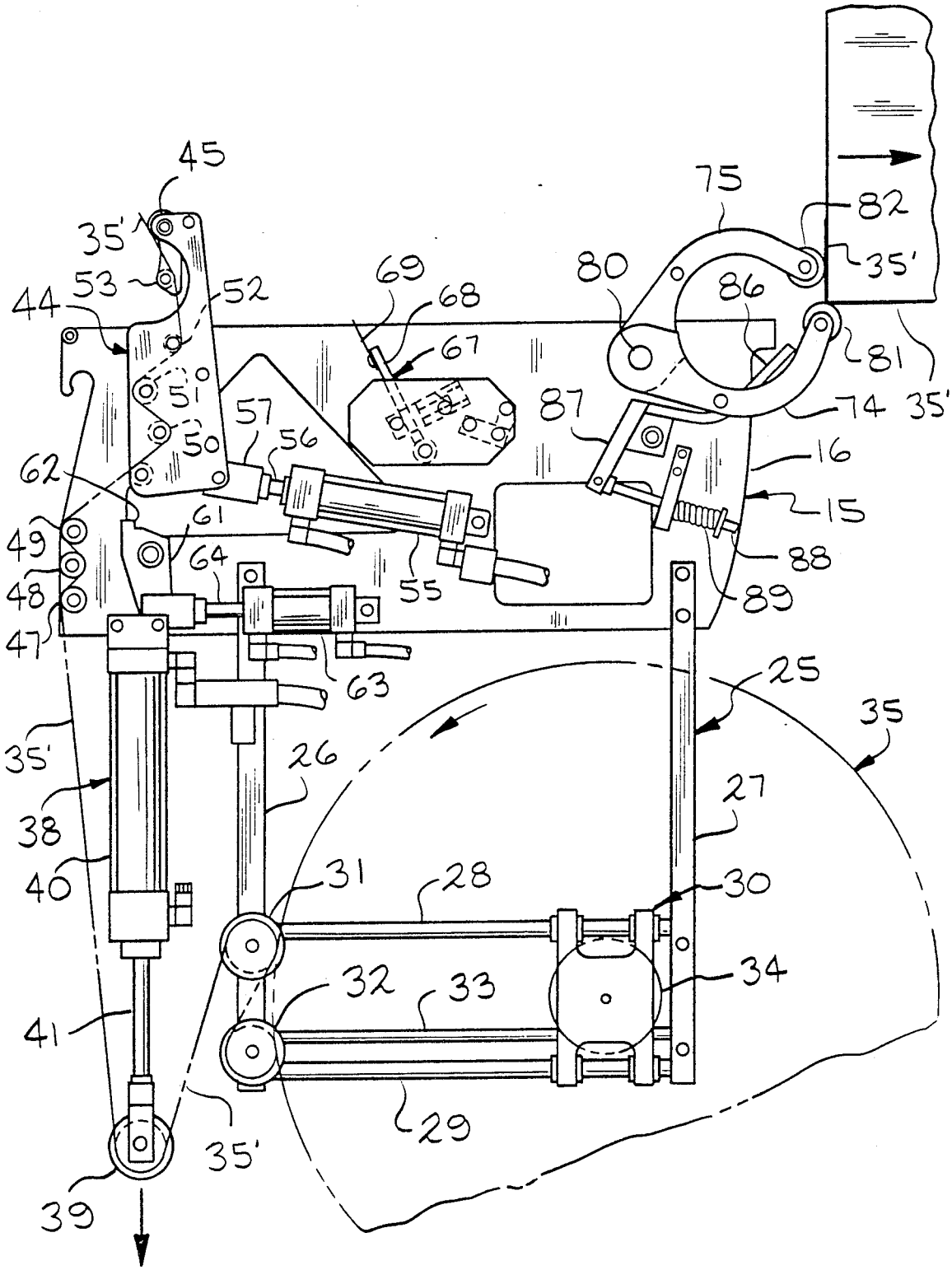

Referring to FIG. 10, the drive roller 39 of the strip assembly 38 continues its downward movement and the wiping rollers 81 and 82 of the wipe down assembly 73 complete the pressing of the L-clip as the carton assembly 18 continues to move away from the tape machine 15. After this position, the tape machine 15 recycles to the FIG. 1 position where an additional carton assembly is moved along the tape machine 15. The return spring assembly 85 returns the wipe down assembly 73 to its closed gravity position as shown in FIG. 1.

It should be understood that the operation of the tape machine 15 may be modified to, for example, produce a C-clip wherein the tape extends completely across the bottom of the carton assembly or to various other operations. In addition, various revisions may be made to the components described above without departing from the scope of the following claims.

What I claim is:

1. A tape machine for applying tape to a carton assembly moving along a predetermined path, including at least one sidewall, a tape assembly depending from said sidewall, a stripper assembly mounted adjacent said tape assembly, a tape head pivotally mounted adjacent such predetermined path, a trigger assembly operatively connected to said tape head, said trigger assembly including a trigger member operatively connected to said tape head for retarding pivoting of said tape head in one position and releasing said tape head for pivoting when in a second position, means operatively connected to said trigger member for moving said trigger member between such first and second positions, a knife means mounted adjacent said tape head for severing the tape and a wipe down assembly adjacent said path for pressing tape against such carton assembly.

2. A tape machine, according to claim 1, wherein said tape machine includes two opposed and spaced sidewalls.

3. A tape machine, according to claim 1, wherein said tape assembly comprises depending arms extending downwardly from said sidewall, a cross arm extending between said depending arms and a slide assembly mounted on said cross arm, said slide assembly including a spool for mounting a roll of tape.

4. A tape machine, according to claim 3, wherein at least two cross arms extend between said depending arms and said slide assembly is mounted on said cross arms and spring means for urging said slide assembly toward one of said depending arms.

5. A tape machine, according to claim 4, including an upper one way roller mounted on said one of said depending arms and a lower roller mounted beneath said upper one way roller, said slide assembly being biased toward said rollers.

6. A tape machine, according to claim 1, wherein said stripper assembly includes a drive roller which engages the tape and pulls it from a roll of tape mounted by said tape assembly.

7. A tape machine, according to claim 6 including a drive cylinder mounting said drive roller.

8. A tape machine, according to claim 1, wherein said tape head includes an application roller at one end which guides the tape to the carton assembly and a head cylinder operatively connected to said tape head for pivoting said application roller toward and away from such predetermined path.

9. A tape machine, according to claim 1 including a head cylinder having an extendable rod and a block mounted on the distal end of said rod, said block being pivotally attached to said tape head, said trigger member including a notch for receiving said block when said tape head is in said first position.

10. A tape machine, according to claim 1, whereby said knife means includes a blade holder mounted adjacent said tape head on at least one sidewall and a blade mounted in said blade holder, said blade having an upper cutting edge extending across such predetermined path for severing the tape.

11. A tape machine, according to claim 10, wherein said knife is positioned generally perpendicular to such predetermined path and is angularly positioned wherein one side of the blade is higher than the other side, whereby the high side initially engages and cuts the tape.

12. A tape machine, according to claim 11, wherein said blade holder is pivotally mounted and said blade moves generally along such predetermined path during cutting of the tape.

13. A tape machine, according to claim 1, wherein said wipe down assembly includes a pair of curved arms, each of said curved arms having a first end and a second end, said first ends being pivotally mounted to one another and to said sidewall, said second ends each mounting a wiping roller.

14. A tape machine, according to claim 13, wherein said second ends are movable away from and towards one another and spring means for moving said arms from a finished position to a start position.

15. A tape machine for applying tape to a carton assembly moving along a predetermined path, said tape machine comprising a pair of opposed sidewalls, a tape assembly depending from said sidewalls, said tape assembly including depending arms extending downwardly from said sidewalls, a cross arm extending between said depending arms and a roll of tape mounted on said cross arm, a stripper assembly mounted adjacent said tape assembly, said stripper assembly including a drive roller which engages the tape and pulls it from said roll of tape, a drive cylinder operatively connected to said drive roller for reciprocating said drive roller, said tape head pivotally mounted adjacent such predetermined path, said tape head including an application roller at one end for guiding the tape to the carton assembly and a head cylinder operatively connected to said tape head for pivoting said application roller toward and away from such predetermined path, a trigger assembly operatively connected to said tape head, said trigger assembly comprising a trigger member engageable with said tape head for retarding pivoting of said tape when in one position and for releasing said tape head for pivoting when in a second position, a trigger cylinder operatively connected to said trigger member for moving said trigger member between such first and second positions, knife means adjacent said tape head and such predetermined path for severing the tape and a wipe down assembly, including at least one wiping roller for pressing tape applied to the carton assembly.

16. A tape machine for applying a tape to a carton moving along a predetermined path, including at least one sidewall, a tape assembly depending from said sidewall, a stripper assembly mounted adjacent said tape assembly, a tape head pivotally mounted adjacent such predetermined path, a trigger assembly operatively connected to said tape head, said trigger assembly including a trigger member operatively connected to said tape head for retarding pivoting of said tape head in one position and releasing said tape head for pivoting when in a second position, a trigger cylinder operatively connected to said trigger member for moving said trigger member between such first and second positions, a knife means mounted adjacent said tape head for severing the tape and a wipe down assembly adjacent said path for pressing tape against such carton assembly.

* * * * *